US006014595A

United States Patent [19]

Kobayashi

[11] Patent Number: 6,014,595

[45] Date of Patent: Jan. 11, 2000

[54] DETERMINATION OF VEHICLE ASSISTANCE FROM VEHICLE VIBRATION THAT RESULTS WHEN THE VEHICLE CONTACTS VIBRATION GENERATING STRUCTURES ON THE ROAD

[75] Inventor: Minoru Kobayashi, Dublin, Ohio

[73] Assignee: Honda Giken Kogyo Kabushiki Kaisha, Japan

[21] Appl. No.: 08/996,971

[22] Filed: Dec. 23, 1997

[51] Int. Cl.[7] ..... G08G 1/09

[52] U.S. Cl. ..... 701/1; 701/45; 701/213; 340/438

[58] Field of Search ..... 701/1, 45, 47, 701/208, 213; 340/436, 438, 460, 463, 468, 471; 702/56

[56] References Cited

U.S. PATENT DOCUMENTS

| | | | |
|---|---|---|---|
| 5,034,890 | 7/1991 | Sugasawa et al. | 701/37 |
| 5,106,226 | 4/1992 | Fanslow et al. | 404/15 |
| 5,318,143 | 6/1994 | Parker et al. | 180/168 |
| 5,555,312 | 9/1996 | Shima et al. | 382/104 |
| 5,568,137 | 10/1996 | Liu | 340/905 |
| 5,684,490 | 11/1997 | Young et al. | 342/70 |
| 5,765,116 | 6/1998 | Wilson-Jones et al. | 701/41 |
| 5,890,083 | 3/1999 | Franke et al. | 701/45 |

FOREIGN PATENT DOCUMENTS 7160993 6/1995 Japan .

*Primary Examiner*—Michael J. Zanelli
*Attorney, Agent, or Firm*—Monica H. Choi

[57] ABSTRACT

A vehicle assistance system uses vehicle vibration resulting when the vehicle rides over predetermined vehicle vibration generating structures on the road. Each of at least one vibration sensor is disposed on a respective location on the vehicle and generates a respective vibration signal when the vehicle rides over a vehicle vibration generating structure on the road. A vibration signal analyzer determines a driving situation from the respective vibration signal generated by the at least one vibration sensor. The vibration generating structure has a predetermined shape for causing a predetermined effect on the respective vibration signal detected at the at least one location to indicate a corresponding driving situation. The vehicle assistance system of the present invention further includes a warning unit to warn at least one of the driver of the vehicle or another person on the road of the driving situation. In addition, a vehicle control unit may automatically compensate for the driving situation to further enhance vehicle safety.

41 Claims, 10 Drawing Sheets

DETERMINATION OF VEHICLE ASSISTANCE FROM VEHICLE VIBRATION THAT RESULTS WHEN THE VEHICLE CONTACTS VIBRATION GENERATING STRUCTURES ON THE ROAD

TECHNICAL FIELD

This invention relates to vehicle assistance systems, and more particularly to analyzing vibration of a vehicle when the vehicle contacts vibration generating structures on the road to assist the driver of the vehicle on the road.

BACKGROUND OF THE INVENTION

Vehicle assistance systems, such as vehicle guidance and accident prevention systems, of the prior art detect electromagnetic signals from the road. For example, U.S. Pat. No. 5,684,490 to Young et al. discloses a highway vehicle guidance system which transmits radar pulses forward of the vehicle. Such pulses are reflected back by a frequency selective strip for detection by a radar receiver. The reflected radar pulse signals are analyzed to guide the vehicle along the highway. Similarly, U.S. Pat. No. 5,318,143 to Parker et al. discloses a lane sensing system which includes an optical transmitter for emitting a light toward a highway lane. The light reflected from a center stripe is analyzed for automatic vehicle steering. In addition, U.S. Pat. No. 5,568,137 to Liu includes a photo sensor mechanism for detecting light that is reflected from light-reflective lane markers for alerting the driver that the vehicle may be deviating out of a lane.

These prior art vehicle assistance systems transmit and/or detect electromagnetic waves. Such transmitters and detectors may be costly to implement. Furthermore, analysis of such electromagnetic waves may require relatively complicated signal analysis, especially for optical systems when background light may vary from day-time to night-time. Moreover, the electromagnetic waves may be difficult to detect because of scattering of the electromagnetic waves in foggy, rainy, or snowy weather, and the strips and lines used in these systems may become completely undetectable during heavy fog, or heavy rain, or even light snow accumulation on the road. However, the driver of the vehicle may require most assistance, especially accident prevention assistance, during such adverse weather conditions. In addition, the reflective strips or lines used in these prior art vehicle assistance systems may wear out with time.

U.S. Pat. No. 5,555,312 to Shima et al. discloses an automobile apparatus that recognizes road traffic lines and a car running ahead of a vehicle from a video image recording unit such as a TV camera mounted on the car. However, such a video image recording unit and video image signal processing may be relatively costly to implement. Moreover, this system also may become ineffective in adverse weather conditions of heavy fog, rain, or even light snow.

Other vehicle assistance systems of the prior art include embedding magnetic keys on the road and detecting the resulting magnetic field with magnetic sensors installed on the vehicle. However, the magnetic sensors and installation of magnetic keys on the road may require relatively high cost. In addition, installation on the road of such magnetic keys or the frequency selective strips of Young et al. may be useless for vehicles that do not have the corresponding vehicle assistance system installed thereon.

Furthermore, some prior art vehicle assistance systems combine the prior art detection technology as described herein with navigation technology using GPS (Global Positioning System) information and/or roadmap information.

However, such vehicle assistance systems are limited by navigation precision and the ability to receive GPS signals.

SUMMARY OF THE INVENTION

Accordingly, in light of these disadvantages of the prior art, a primary object of the present invention is to implement a relatively low cost yet more effective vehicle assistance system. In addition, the vehicle assistance system of the present invention utilizes any already existent infrastructure of the road. The road infrastructure used in the present invention may benefit all vehicles to some extent whether or not such vehicles have the vehicle assistance system of the present invention installed thereon.

In a general aspect of the present invention, an apparatus and a method of the present invention assists a driver of a vehicle on a road having vibration generating structure. The present invention includes at least one vibration sensor with each such vibration sensor being disposed on a respective location on the vehicle. Each such vibration sensor detects vibration of the vehicle when the vehicle contacts the vibration generating structure on the road to generate a respective vibration signal. A vibration signal analyzer determines a driving situation of the vehicle from analysis of the respective vibration signal from the at least one vibration sensor. The vibration generating structure may have a predetermined shape for causing a predetermined effect on the respective vibration signal detected by the at least one vibration sensor to indicate a corresponding driving situation. Furthermore, the respective location corresponding to each of the respective vibration signals may also be used to determine the driving situation.

In another aspect of the present invention, the present invention further includes a warning unit for warning the driver of the vehicle and/or another person on the road of the driving situation of the vehicle. The present invention may further include a vehicle control unit for automatically controlling the vehicle to compensate for the driving situation of the vehicle.

The present invention can be used to particular advantage for preventing vehicular accidents of the types which may occur when the vehicle is running off a lane, when the vehicle is approaching an intersection, and when the vehicle is approaching a curve. The present invention determines such driving situations and provides a respective warning or a respective automatic vehicle assist action for each driving situation.

In addition, the present invention can be used to particular advantage in conjunction with other vehicle assistance systems such as vehicle navigation systems or crash detection systems in determining proper assistance to the driver of the vehicle.

These and other features and advantages of the present invention will be better understood by considering the following detailed description of the invention which is presented with the attached drawings.

BRIEF DESCRIPTION OF THE DRAWINGS

The figures referred to herein are drawn for clarity of illustration and are not necessarily drawn to scale. Elements having the same reference numeral in FIGS. 1–17B refer to elements having similar structure and function.

DETAILED DESCRIPTION

The present invention uses vehicle vibration that results when a vehicle on the road makes contact with vibration generating structures on the road. Such vibration generating structures (which are also referred to as "rumble-strips") already exist on the highway infrastructure, typically to alert the driver to reduce speed. For example, such rumble-strips are common near toll booths on the highway to further ensure that vehicles do not run into the toll booths which may contain highway employees. The driver hears the vehicle vibration or experiences a body vibration when the tires of the vehicle contact such a vibration generating structure, and the driver is thus alerted to reduce speed. Such vibration generating structures may be critical for alerting a drowsy or otherwise inattentive driver.

The present invention uses vehicle vibrations that result when a vehicle on the road makes contact with vibration generating structures on the road in a more sophisticated manner. The vibration sensations experienced by the driver alone may not be sufficient for preventing vehicular accidents, especially for the aged or those who are hard of hearing.

Figure 1:
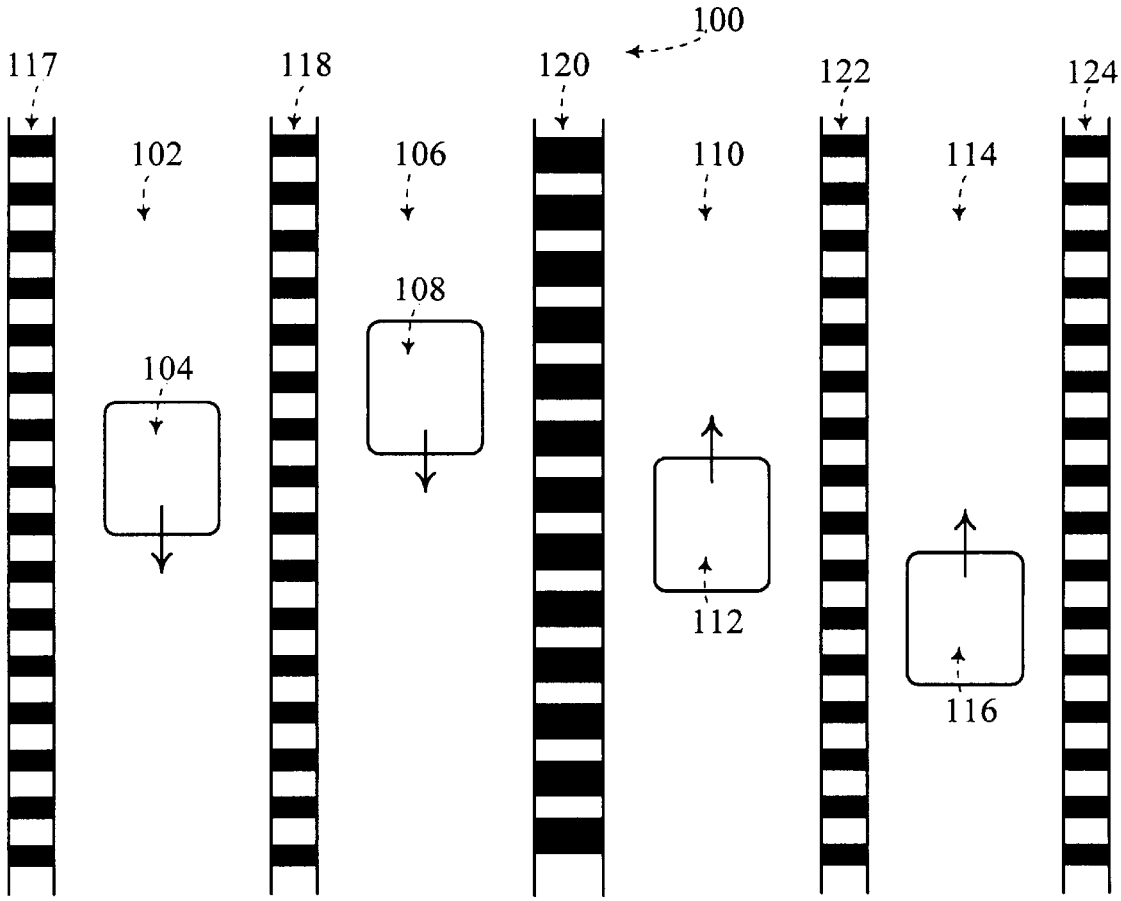
FIG. 1 shows vibration generating structures for defining lanes on the road.

Referring to FIG. 1, a road 100 includes multiple lanes. A first lane 102 has a first vehicle 104 traveling in the south-bound direction, and a second lane 106 has a second vehicle 108 traveling in the south-bound direction. Thus, the first and second lanes 102 and 106 respectively are lanes for the same direction of travel. A third lane 110 has a third vehicle 112 traveling in the north-bound direction, and a fourth lane 114 has a fourth vehicle 116 traveling in the north-bound direction. Thus, the third and fourth lanes 110 and 114 respectively are lanes for the same direction of travel which is the opposite direction of travel of the first and second lanes 102 and 106 respectively.

According to one embodiment of the present invention, vibration generating structures are disposed between the lanes and the sides of the road to define the lanes. A first vibration generating structure 117 is disposed on the outside of the first lane 102. A second vibration generating structure 118 is disposed between the first lane 102 and the second lane 106. A third vibration generating structure 120 is in the center of the second lane 106 and the third lane 110. A fourth vibration generating structure 122 is disposed between the third lane 110 and the fourth lane 114. A fifth vibration generating structure 124 is disposed on the outside of the fourth lane 114.

Figure 2A:
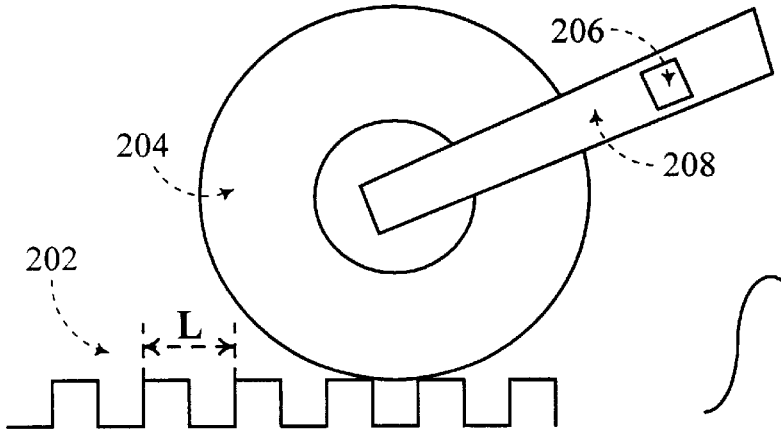
FIG. 2A shows a vibration sensor disposed near a tire of a vehicle which makes contact with a vibration generating structure on the road.

Each of the vibration generating structures 117, 118, 120, 122, and 124 have a respective shape for causing a vibration on a vehicle that rides over such a vibration generating structure. Referring to FIG. 2, a typical shape of such a vibration generating structure includes periodic grooves 202. When a tire 204 of a vehicle makes contact with the vibration generating structure 202, the tire 204 and vehicle both vibrate.

The present invention includes a vibration sensor 206 disposed on or near a suspension mechanism 208 of the tire 204. The vibration sensor 206 is thus disposed at a respective location on the vehicle and detects the vibration generated at that respective location when the tire 204 of that vehicle runs over the vibration generating structure 202. The vibration sensor 206 may be a piezoceramic element which senses structural stress with the vehicle vibration, or alternatively, the vibration sensor 206 may be a microphone that senses vibration sounds generated from the vehicle vibration. The present invention may be practiced with any other type of vibration sensors.

Figure 2B:
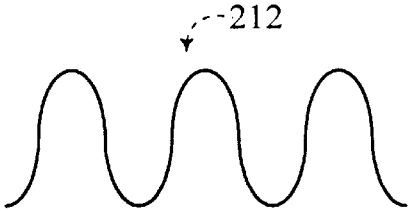
FIG. 2B shows a vibration signal generated by the vibration sensor of FIG. 2A, according to one embodiment of the present invention.

In any case, the vibration sensor 206 generates a vibration signal 212 of FIG. 2B when the vehicle vibrates. When the tire 204 rolls over the periodic grooves 202, the vehicle vibrates with a frequency, F. The vibration signal 212 thus also has a frequency of F. If the vehicle is traveling at a speed of V, and the periodic grooves 202 have a groove length L for each groove period as shown in FIG. 2B, then the following relation results:

$$F=V/L \text{ (Hertz)}$$

$$L=V/F$$

Thus, if the frequency F is determined from the vibration signal 212 and the vehicle velocity V is determined, then the groove length L may be determined from the above relation. This determination is particularly advantageous for the present invention because each groove length L may indicate a respective driving situation of the vehicle when the vehicle rides over such periodic grooves having that groove length.

Figure 3A:
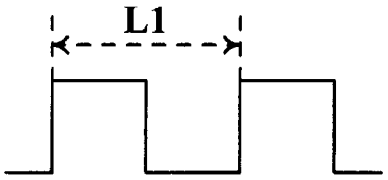
FIGS. 3A, 3B, and 3C show example shapes for vibration generating structures on the road.

For example, referring back to FIG. 1, the first, second, fourth, and fifth vibration generating structures 117, 118, 122, and 124 respectively may have a first groove length L1 as shown in FIG. 3A. When a vehicle rides over any of these vibration generating structures, the vibration sensor 206 of that vehicle generates a vibration signal having a respective frequency F1=V/L1. The value of L1 is determined from F1 and the velocity V of the vehicle. Such a value of L1 indicates a respective driving situation that the vehicle is running off a lane and into one of the vibration generating structures 117, 118, 122, and 124.

Figure 3B:
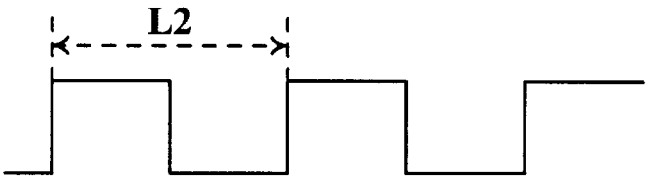

Alternatively, the third vibration generating structure 120 which is at the center of the lanes having direction of travel in opposite directions, may have a second groove length L2 as shown in FIG. 3B. When a vehicle rides over that vibration generating structure 120, the vibration sensor 206 of that vehicle generates a vibration signal having a respective frequency F2=V/L2. The value of L2 is determined from F2 and the velocity V of the vehicle. Such a value of L2 indicates a respective driving situation that the vehicle is in danger of running into a lane that has vehicles traveling in the opposite direction.

Figure 3C:
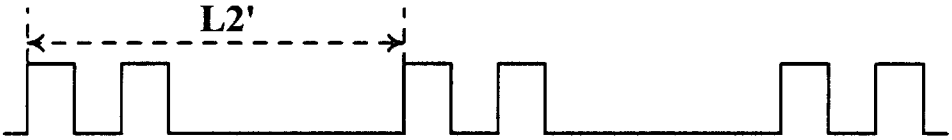
Figure 3D:
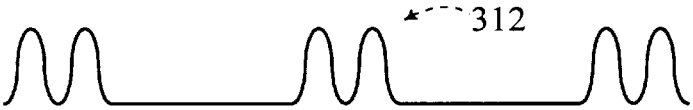
FIG. 3D shows a vibration signal that may result when the vehicle makes contact with the vibration generating structure of FIG. 3C.

Furthermore, the present invention may be practiced with any other vibration generating structure shapes. For example, a vibration generating structure shape of FIG. 3C, having a groove length of L2' may be for generation of a corresponding vibration signal 312 of FIG. 3D. The main frequency component of a vibration signal may be more readily determined from such a vibration signal 312 than from the vibration signal 212 of FIG. 2B. In any case, the present invention may be practiced with any other advantageous vibration generating structures.

Figure 4:
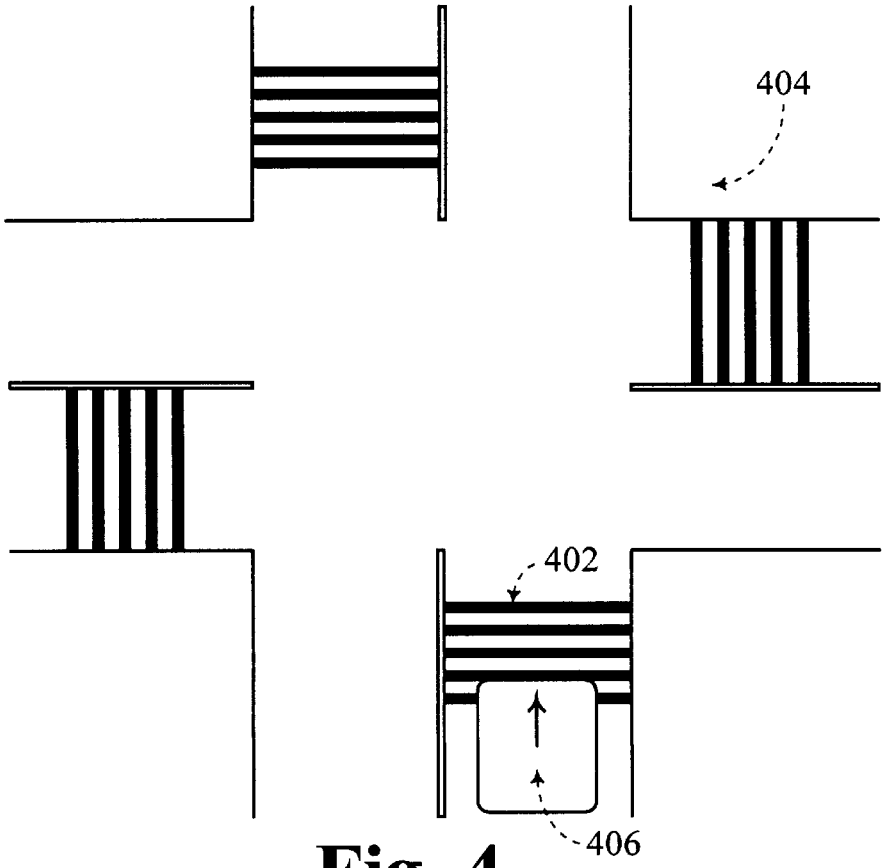
FIG. 4 shows vibration generating structures disposed near a road intersection.

Additionally, another vibration generating structure having another groove length L3 may be used to indicate a respective driving situation that the vehicle is approaching an intersection. Referring to FIG. 4, such a vibration generating structure 402 is disposed on the road near an intersection 404. As a vehicle 406 approaches the intersection, the vehicle 406 rides over the vibration generating structure 402 a predetermined distance before the intersection 404. A vibration sensor of that vehicle 402 generates a vibration signal having a respective frequency F3=V/L3. The value of L3 is determined from F3 and the velocity V of the vehicle. Such a value of L3 indicates a respective driving situation that the vehicle is in danger of running into the intersection 404.

Figure 5A:
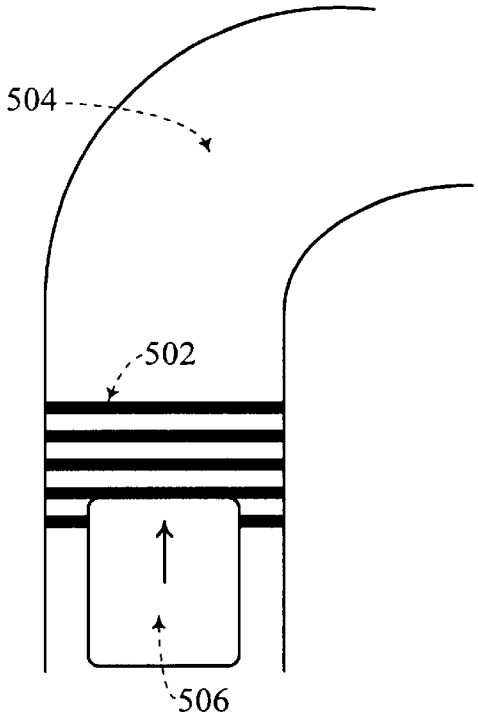
FIG. 5A shows vibration generating structures disposed at the approach of a road curve.

Likewise, another vibration generating structure having another groove length L4 may be used to indicate a respective driving situation that the vehicle is approaching a curve. Referring to FIG. 5A, such a vibration generating structure 502 is disposed on the road a predetermined distance before a curve 504. As a vehicle 506 approaches the curve 504, the vehicle 506 rides over the vibration generating structure 502 the predetermined distance before the curve 504. A vibration sensor of that vehicle 506 generates a vibration signal having a respective frequency F4=V/L4. The value of L4 is determined from F4 and the velocity V of the vehicle. Such a value of L4 indicates a respective driving situation that the vehicle is in danger of running off the road if the vehicle does not slow down before the curve 504.

Figure 5B:
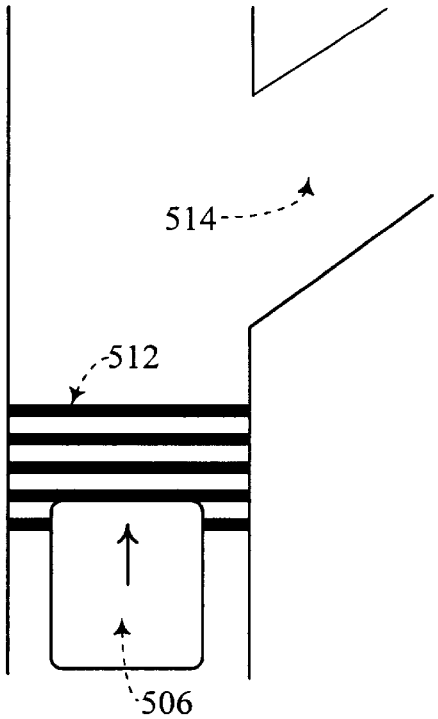
FIG. 5B shows vibration generating structures disposed at the approach of an exit.

Similarly, another vibration generating structure having another groove length L5 may be used to indicate a respective driving situation that the vehicle is approaching an exit. Referring to FIG. 5B, such a vibration generating structure 512 is disposed on the road a predetermined distance before an exit 514. As the vehicle 506 approaches the exit 514, the vehicle 506 rides over the vibration generating structure 512 the predetermined distance before the exit 514. A vibration sensor of that vehicle 506 generates a vibration signal having a respective frequency F5=V/L5. The value of L5 is determined from F5 and the velocity V of the vehicle. Such a value of L5 indicates a respective driving situation that the vehicle is the predetermined distance before the exit 514 and that the driver of the vehicle 506 should decide whether to get off on exit 514.

Figure 6:
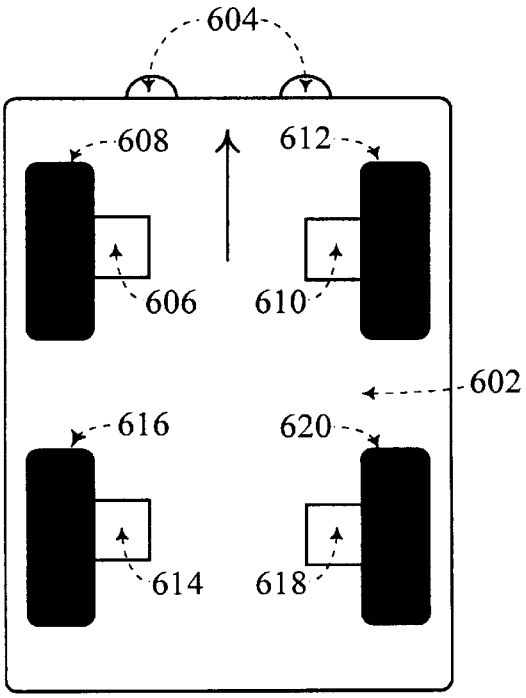
FIG. 6 shows a plurality of vibrations sensors with each such vibration sensor disposed near a respective tire of a vehicle, according to one embodiment of the present invention.

A location of a vibration sensor may also be used for determining the driving situation. Referring to FIG. 6, each of a plurality of vibration sensors are disposed on a respective location on a vehicle 602. Headlights 604 indicate the front of the vehicle 602. A first vibration sensor 606 is disposed near a front left tire 608, a second vibration sensor 610 is disposed near a front right tire 612, a third vibration sensor 614 is disposed near a rear left tire 616, and a fourth vibration sensor 618 is disposed near a rear right tire 620.

Figure 7:
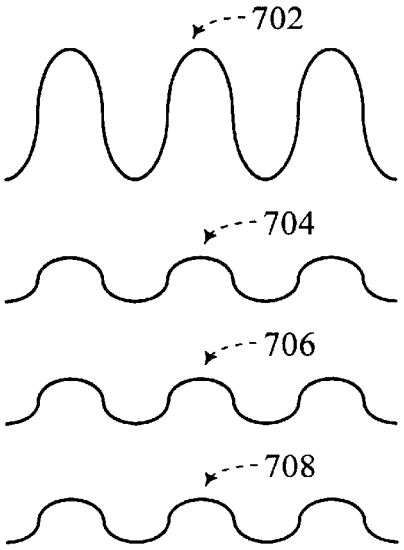
FIG. 7 shows a respective vibration signal detected by each of the plurality of vibration sensors of FIG. 6.

For example, if the front left tire 608 only were to run over a vibration generating structure, then the respective vibration signal generated at each of the plurality of sensors 606, 610, 614, and 618 are shown in FIG. 7. In that case, referring to FIG. 7, a first vibration signal 702 is generated at the first vibration sensor 606, a second vibration signal 704 is generated at the second vibration sensor 610, a third vibration signal 706 is generated at the third vibration sensor 614, and a fourth vibration signal 708 is generated at the fourth vibration sensor 618. The first vibration signal 702 has the largest amplitude of all the vibration signals indicating that the front left tire is making contact with a vibration generating structure. Such information may be useful in determining the current driving situation of the vehicle.

Figure 8A:
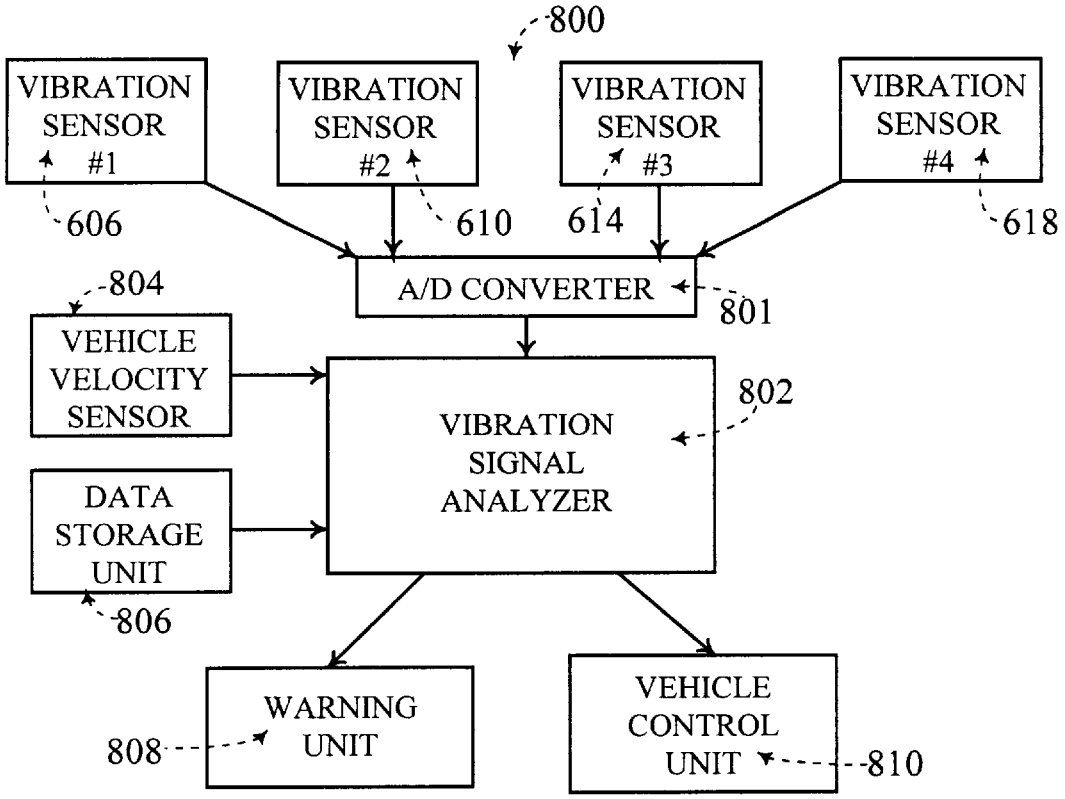
FIG. 8A shows components of a vehicle assistance system using vibration signals generated by the vibration sensors of FIG. 6, according to one embodiment of the present invention.

Referring to FIG. 8A, a vehicle assistance system 800 of the present invention thus uses the respective vibration signal detected by each of the at least one vibration sensor disposed on a vehicle. The at least one vibration sensor may include the first sensor 606, the second sensor 610, the third sensor 614, and the fourth sensor 618 of FIG. 6 for example. These sensors are coupled to an A/D (Analog to Digital) converter 801 which converts an analog vibration signal into a digital form. The output of the A/D converter 801 is coupled to a vibration signal analyzer 802 which may be any data processing unit used within a vehicle as is known to one of ordinary skill in the art of vehicle electronic systems design.

The vibration signal analyzer 802 accepts the digital form of the respective vibration signal generated at each of the at least one vibration sensor 606, 610, 614, and 618 from the A/D converter 801. The vibration signal analyzer also accepts the vehicle speed V from a vehicle velocity sensor 804. The vehicle velocity sensor 804 is a component such as a speedometer of the vehicle which determines vehicle speed as is known to one of ordinary skill in the art of vehicle systems design. The vibration signal analyzer 802 determines the frequency F of a vibration signal having significant amplitude when the vehicle makes contact with a vibration generating structure on the road. Then, the vibration signal analyzer 802 determines the groove length L=V/F of the vibration generating structure that the vehicle has just contacted.

The vibration signal analyzer 802 then looks up a respective driving situation corresponding to this value of groove length L in a look-up table within a data storage unit 806. The data storage unit 806 is any data memory device that may be used in vehicles as is known to one of ordinary skill in the art of vehicle electronic systems design. For example, if L is the value L1 (i.e., the groove length of the vibration generating structures 117, 118, 122, or 124 used on the sides of lanes in FIG. 1), then the respective driving situation is that the vehicle is running off a lane. If L is the value L3 (i.e., the groove length of the vibration generating structure 402 used near the intersection 404 of FIG. 4), then the respective driving situation is that the vehicle is approaching an intersection. If L is the value L4 (i.e., the groove length of the vibration generating structure 502 used near the curve 504 of FIG. 5A), then the respective driving situation is that the vehicle is approaching a curve. If L is the value L5 (i.e., the groove length of the vibration generating structure 512 used near the exit 514 of FIG. 5B), then the respective driving situation is that the vehicle is approaching an exit. Because of the many different possible values of the groove length L, the present invention may be used to indicate many different driving situations.

Once the driving situation is determined, the vehicle assistance system 800 of the present invention includes a warning unit 808 to assist the driver of the vehicle by warning the driver of the driving situation. The look-up table within the data storage unit 806 may also indicate an appropriate respective warning to be provided for each respective driving situation corresponding to each groove length. For example, if the driving situation is that the vehicle is running off a lane, or approaching an intersection or curve, the warning unit 808 may create a loud warning sound to alert a drowsy or otherwise inattentive driver or may include a voice-synthesis unit that warns the driver of each driving situation by voice. In addition, another person on the road, especially another driver on the road, may also be warned with the warning unit 808 automatically turning on emergency flashers or flashing the headlights of the vehicle or automatically sounding the vehicle horn. As another example, if the vehicle is approaching an exit as in FIG. 5B, then the vehicle may notify the driver of that driving situation by display or by voice-synthesis. The present invention may be practiced with any type of alerting or warning device.

In addition, the vehicle assistance system 800 of the present invention also includes a vehicle control unit 810 to assist the driver of the vehicle by automatically controlling the vehicle to compensate for the driving situation. The look-up table within the data storage unit 806 may also indicate an appropriate respective automatic vehicle assist action to compensate for the respective driving situation corresponding to each groove length. For example, if the driving situation is determined to be that the vehicle is running off a lane, then the vehicle control unit 810 may automatically steer the vehicle back onto the lane. If the driving situation is determined to be that the vehicle is approaching an intersection, then the vehicle control unit 810 may automatically reduce the vehicle speed and may eventually even automatically stop the vehicle in some cases.

For example, assume that the determined driving situation is that the vehicle is a predetermined distance D before a stopped intersection or before a toll booth indicating that the vehicle should be stopped within the predetermined distance D. Then the vehicle control unit 810 may use the brakes and throttle control of the vehicle to automatically stop the vehicle within the predetermined distance D. If the current speed of the vehicle is v, then the amount of deceleration $\alpha$ that is required to stop the vehicle may be calculated as follows:

$$D=vt-\tfrac{1}{2}\alpha t^2$$

$$0=v-\alpha t$$

$$\alpha=2v^2/D,$$

where t is a time variable.

Figure 8B:
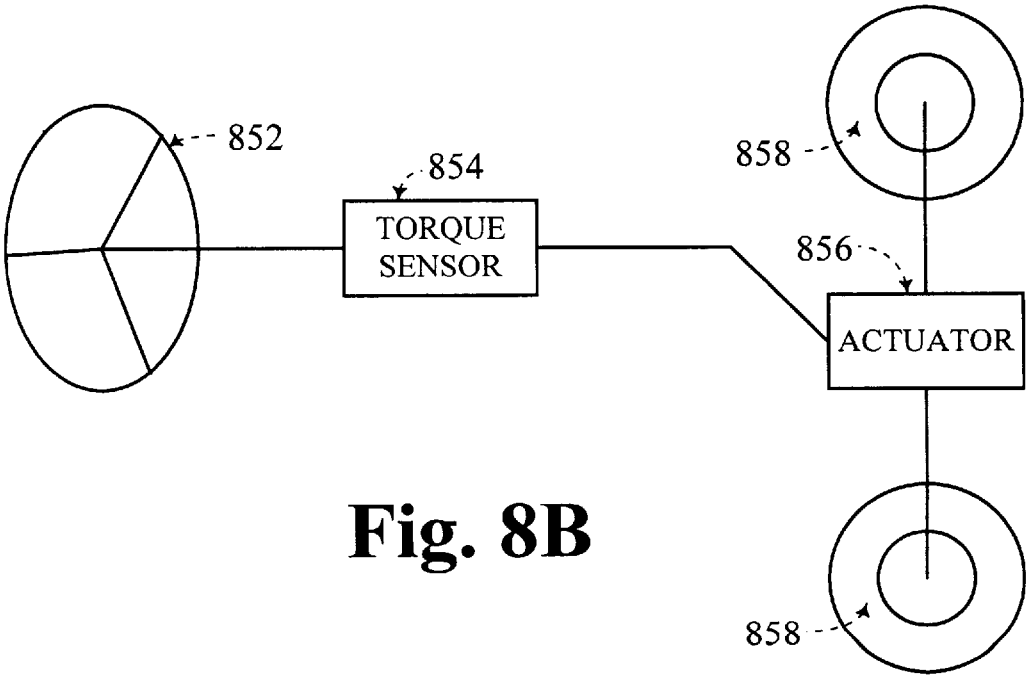
FIG. 8B shows components of a vehicle steering system used by the vehicle assistance system of FIG. 8A.

The warning unit 808 and the vehicle control unit 810 may be used in conjunction such that a warning is provided first before an automatic vehicle assist action is applied. In that case, if the driver of the vehicle manually begins to control the vehicle, the vehicle control unit 810 allows the manual control to override any automatic vehicle assist action. Referring to FIG. 8B for example, a steering wheel 852 is coupled to a torque sensor 854. The torque sensor 854 controls an actuator 856 to maneuver tires 858. In this example, the torque sensor 854 coupled to the steering wheel 852 may be used to detect manual steering by the driver. This manual control override is particularly advantageous for ensuring further safety of the driver who may need manual control of the vehicle because a vehicle assistance system may not be able to account for all the myriad of possible circumstances on the road.

Figure 9:
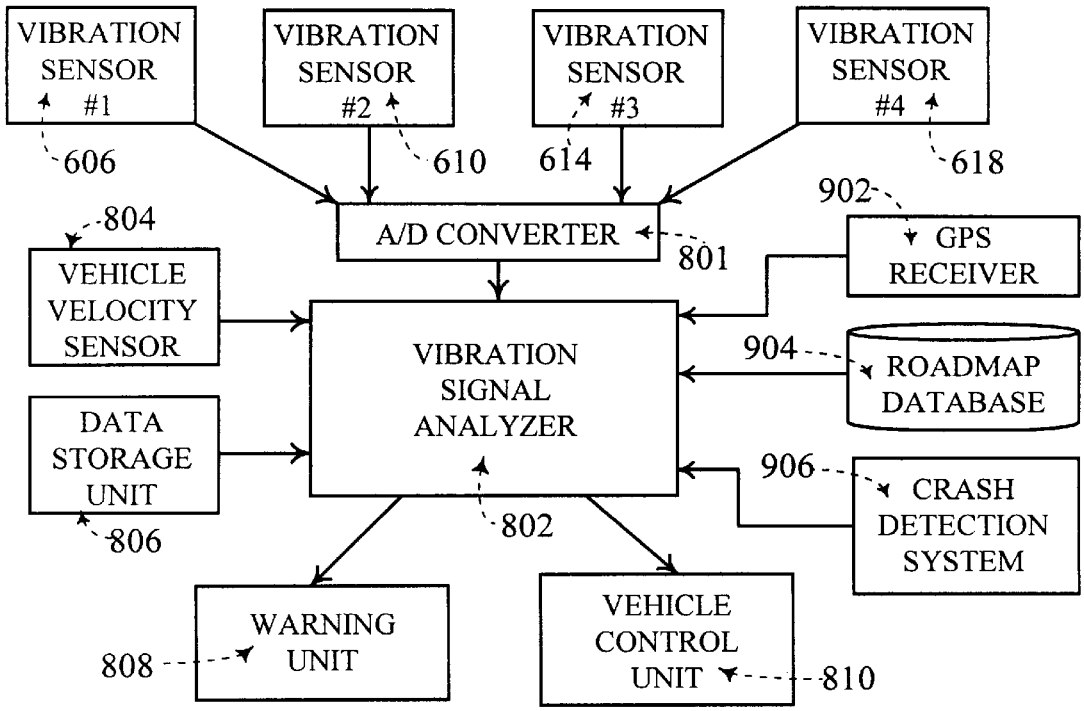
FIG. 9 shows additional vehicle components for providing additional information to the vehicle assistance system of FIG. 8A.

Additionally, the vehicle assistance system 800 of the present invention may be used with any other type of vehicle assistance systems to better determine the driving situation. For example, referring to FIG. 9, the vehicle assistance system 800 may further include inputs from a GPS receiver 902 for accepting GPS (Global Positioning System) information and/or from a roadmap database 904 for accepting roadmap information.

The GPS receiver 902 and the roadmap database 904 are typically used in vehicle navigation systems. The roadmap database 904 according to one embodiment of the present invention may include vibration generating structure information for more accurate navigation. For example, a respective vibration generating structure may be disposed a predetermined distance before each exit on a highway. The roadmap database 904 may include information regarding a respective exit corresponding to each respective vibration generating structure.

Then, when the vehicle makes contact with such a respective vibration generating structure a predetermined distance before an exit, the vibration signal analyzer analyzes the resulting vibration signal and determines which exit is approaching by looking up the vibration generating structure information within the roadmap database 904. The warning unit 808 then warns the driver, for example: "THE NEXT EXIT IS FOR SPRINGFIELD AND IS TWO MILES AWAY." This embodiment of the present invention thereby provides a more accurate vehicle navigation system by using added information regarding vehicle vibration generating structures on the road.

Alternatively, the GPS information and roadmap information may be used for more accurate determination of the driving situation. As snow or debris accumulate within the vibration generating structure, analysis of the vibration signals alone may become insufficient for accurately determining the driving situation. In that case, added information from the GPS receiver 902 and from the roadmap database 904 may aid in determination of the current driving situation. For example, the GPS information may indicate that the vehicle is between two exits on the road. Because of snow or debris accumulation within the vibration generating structure, the exact groove length may become difficult to determine. In that case, the vehicle may resort to simply counting contacts with each vibration generating structure along the road. The roadmap database 904 may include vibration generating structure information that correlates each such count to a respective driving situation.

Alternatively, the vehicle assistance system 800 of the present invention may be used with a crash detection system 906. Such a crash detection system 906 is common in vehicles that include airbags such that the airbags may be deployed in the case of the vehicle crashing into another object. The input from the crash detection system 906 may be advantageously used by the vibration signal analyzer in determining the driving situation of the vehicle when the vehicle is involved in an accident. Such determination may be critical for an appropriate automatic assist action. For example, if the given vehicle is running off the lane, and another vehicle in an accident situation is coming into that lane, then the given vehicle may not return to that lane. Rather, the more appropriate automatic assist action may be to slow down the given vehicle to a stop if an accident has been detected by the crash detection system 906.

Accepting inputs from the GPS receiver 902, the roadmap database 904, and the crash detection system 906 are by way of example only. The present invention may be used to particular advantage by accepting further information from any other types of vehicle assistance systems.

Figure 10:
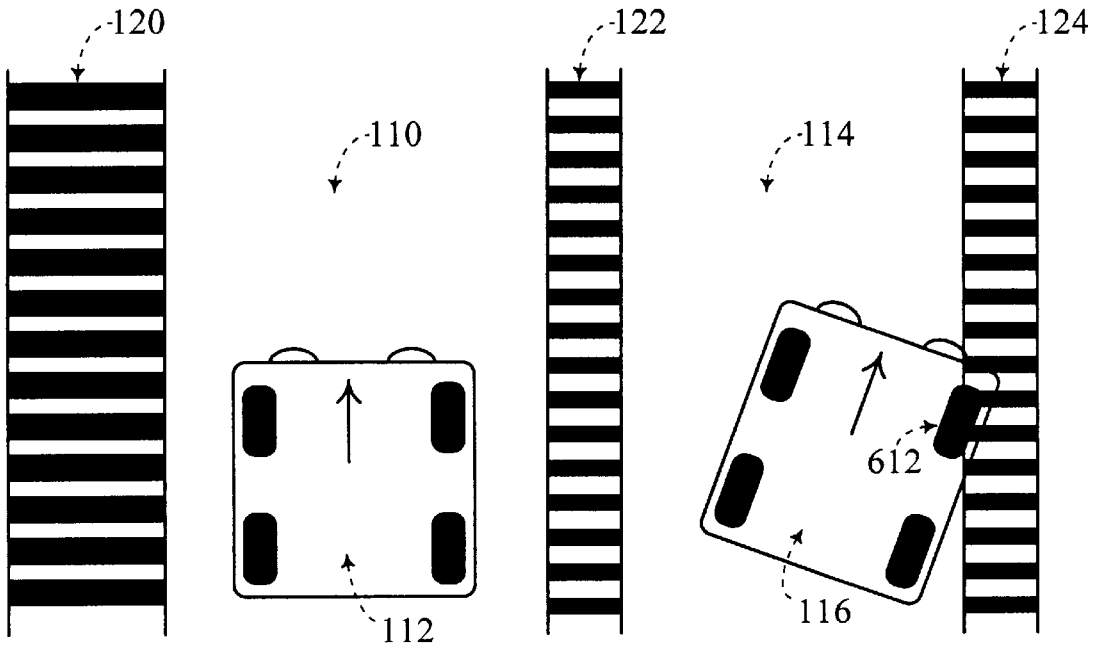
FIG. 10 shows a vehicle running toward the right off a lane.

In addition to analyzing the respective vibration signal generated by each of the at least one vibration sensor in determining the driving situation, the respective location of each vibration sensor also contributes to determining the driving situation. Referring to FIG. 10, the third vehicle 112 traveling north-bound on the third lane 110 and the fourth vehicle 116 traveling north-bound on the fourth lane 114 are shown (as in FIG. 1). The fourth vehicle 116 begins to veer off the fourth lane 114 toward the right. In that case, referring to FIG. 6, the vibration sensor disposed on or near the front right tire 612 generates a respective vibration signal having the largest amplitude as the front right tire 612 makes contact with the fifth vibration generating structure 124. This situation indicates that the driving situation is that the vehicle is veering off the lane to the right.

Figure 11:
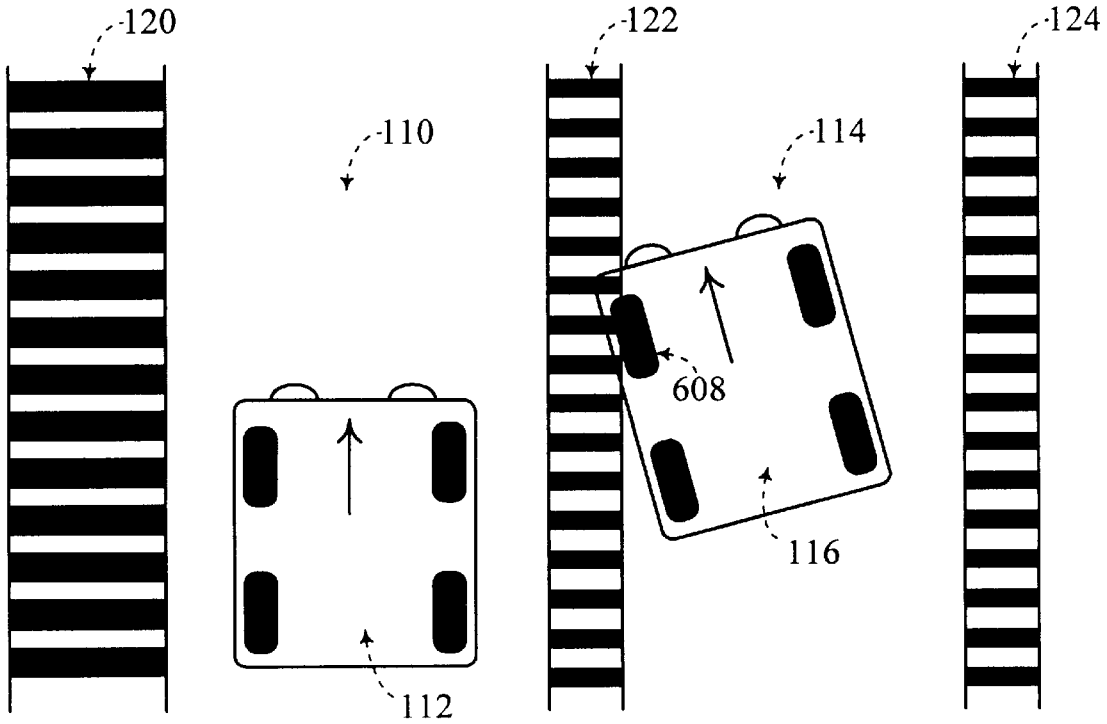
FIG. 11 shows the vehicle of FIG. 9 running toward the left off the lane when the steering of the vehicle is automatically over-compensated from the driving situation of FIG. 10.

The direction of deviation from the road is also useful for determining the appropriate automatic assist action. The vehicle control unit 810 is thus informed to automatically steer the vehicle 116 toward the left to compensate for this driving action. Referring to FIG. 11, if this driving situation is over-compensated by the vehicle control unit 810 such that the fourth vehicle 116 begins to run off the fourth lane 114 toward the left due to this over-compensation, the vibration sensor disposed on or near the front left tire 608 of the fourth vehicle 116 generates a respective vibration signal having the largest amplitude as the left front tire 608 makes contact with the fourth vibration generating structure 122.

Figure 12:
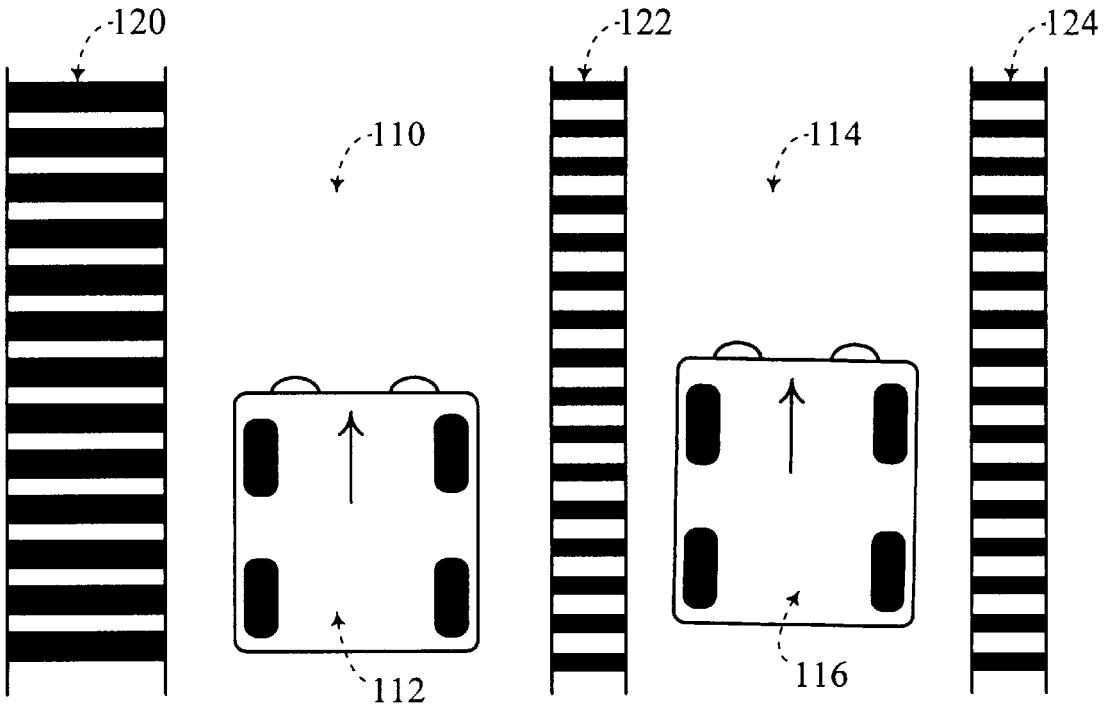
FIG. 12 shows the vehicle of FIGS. 10 and 11 running back within the lane when the steering is automatically iteratively compensated from the driving situations of FIGS. 10 and 11.

The vehicle control unit 810 then controls the vehicle by automatically steering the vehicle slightly toward the right to correct for this over-compensation. The successive compensations may thus be iteratively corrected such that the fourth vehicle 116 is eventually contained within the fourth lane 114 as indicated in FIG. 12. Because another vehicle 112 may be traveling on the third lane 110 which is to the left of the fourth lane 114, such containment within the fourth lane 114 with iterative correction is particularly important for preventing collisions with other vehicles on the road.

Figure 13:
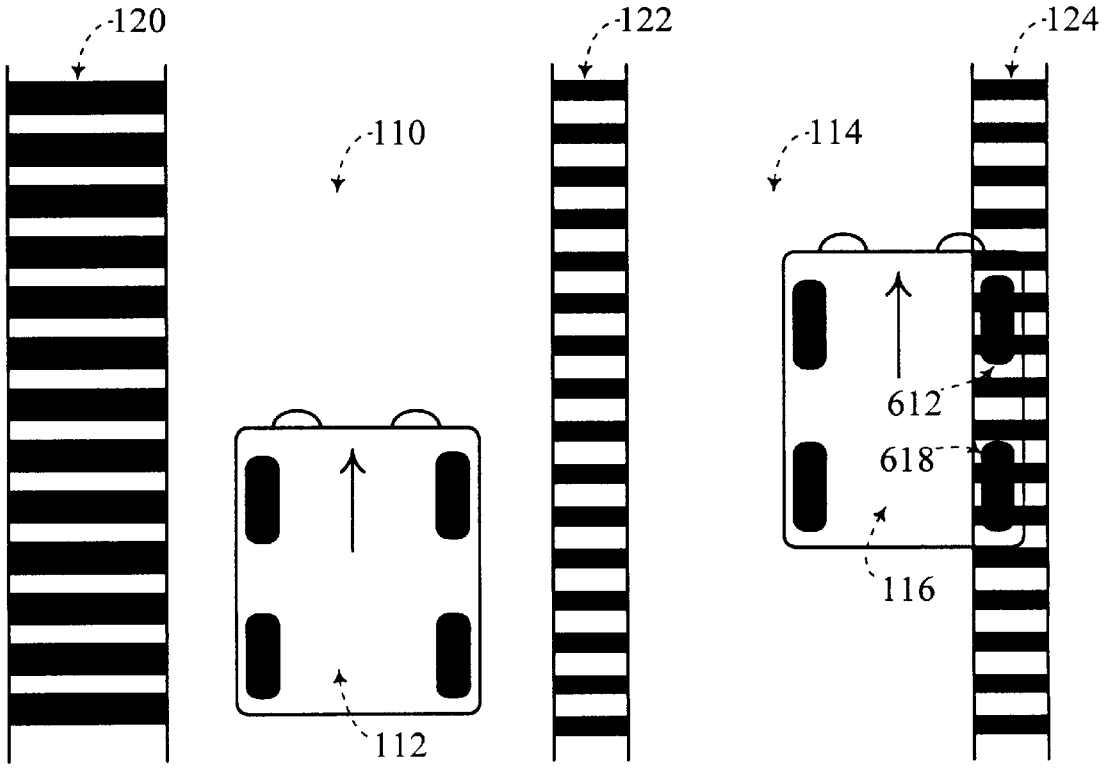
FIG. 13 shows a vehicle that is controlled to run along a vibration generating structure along the side of a lane.

Alternatively, referring to FIG. 13, to ensure that compensation for a driving situation does not lead to further danger of a collision, the fourth vehicle 116 may be controlled to have the right side tires 612 and 618 ride over the fifth vibration generating structure 124 on the outside of the fourth lane 114 when the front right tire 612 begins to run over the fifth vibration generating structure 124 as in FIG. 10. This automatic vehicle assist action may be particularly advantageous when a crash detection system detects vehicle collision. In that case, the fourth vehicle 116 may be controlled to slow down to a stop along the fifth vibration generating structure 124 instead of being steered back toward the lane 114 which may have other vehicles thereon.

In any case, if the driver of the vehicle manually controls the vehicle, such manual control overrides any automatic vehicle assist action by the vehicle control unit 810. The driver of the vehicle may take manual control especially when the warning unit 808 properly warns the driver of the driving situation. The automatic vehicle assist action is useful when the driver has fallen asleep at the wheel or has become otherwise incapacitated from being able to take proper control of the vehicle.

In some situations, the angle between the line of vibration generating structure and the line of vehicle travel may be useful. Referring to FIGS. 10 and 13 for example, such an angle may be useful in automatically controlling the fourth vehicle 116 to follow the line along the fifth vibration generating structure 124 (as in FIG. 13) when the vehicle begins to veer off the lane toward the right (as in FIG. 10).

Figure 14A:
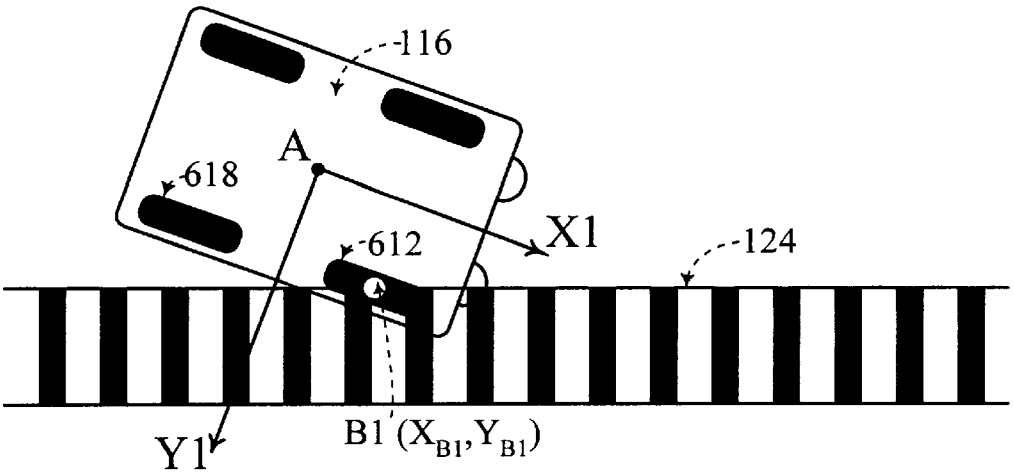
FIGS. 14A, 14B, and 14C show how the angle between the line of the vibration generating structure and the line of vehicle travel may be determined.

Referring to FIG. 14A, assume that the vehicle 116 is beginning to veer off the lane toward the vibration generating structure 124. A point A marks a first vehicle base point which may be determined by vehicle locus estimation with data from the GPS receiver 902 or a gyroscope as is known to one of ordinary skill in the art of vehicle systems design. The first vehicle base point A defines a first coordinate axes X1 and Y1 with the first vehicle base point A being the origin of that first coordinate axes. The front right tire 612 first contacts the vibration generating structure 124 at a point B1 with respect to the first coordinate axes X1 and Y1. The coordinate values $X_{B1}$ and $Y_{B1}$ ($X_{B1}$, $Y_{B1}$) for point B1 are calculated by vehicle specification of the location of the front right tire 612 with respect to the first vehicle base point A.

Figure 14B:
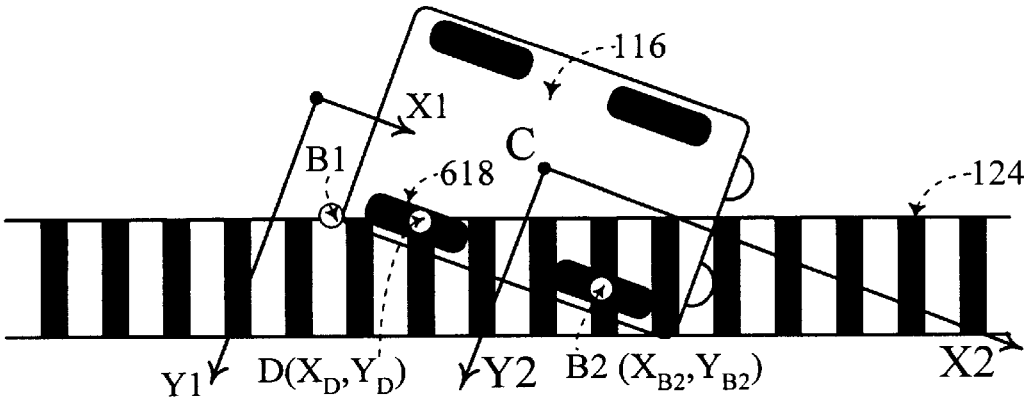

Then, referring to FIG. 14B, as the vehicle 116 travels further into the vibration generating structure 124, the first vehicle base point A has been translated to a second vehicle base point C which may also be determined by vehicle locus estimation with data from the GPS receiver 902 or a gyroscope as is known to one of ordinary skill in the art of vehicle systems design. The second vehicle base point C defines a second coordinate axes X2 and Y2 with the second vehicle base point C being the origin of that second coordinate axes.

The rear right tire 618 first contacts the vibration generating structure 124 at a point D with respect to the second coordinate axes X2 and Y2. The coordinate values $X_D$ and $Y_D$ ($X_D$, $Y_D$) for point D are calculated by vehicle specification of the location of the rear right tire 618 with respect to the second vehicle base point C. Furthermore, the point B1 which had coordinates ($X_{B1}$, $Y_{B1}$) with respect to the first coordinate axes X1 and Y1 may be translated to another point B2 which defines the point of location of the front right tire 612 having coordinates ($X_{B2}$, $Y_{B2}$) with respect to the second coordinate axes X2 and Y2 using linear algebra principles as is known to one of ordinary skill in the art.

Figure 14C:
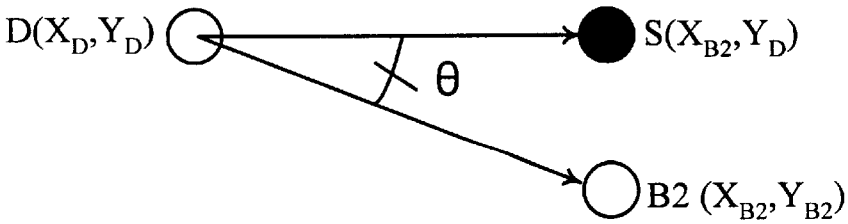

Referring to FIG. 14C, once the coordinates ($X_D$, $Y_D$) of point D and the coordinates ($X_{B2}$, $Y_{B2}$) of point B2 have been determined, the angle θ (Theta) between the line of the vibration generating structure 124 (i.e., the line between point D and a point S in FIG. 14C) and the line of vehicle travel (i.e., the line between the point D and the point B2 in FIG. 14C) may be determined. The third point S is determined to have the X-coordinate $X_{B2}$ of point B2 and the Y-coordinate $Y_D$ of point D. From the three points D, B2, and S, the angle θ may be determined using linear algebra principles as is known to one of ordinary skill in the art.

This angle θ may be useful in determining the proper amount of compensation for a driving situation. For example the angle θ may determine the amount of automatic steering required to prevent the vehicle 116 from veering off the lane 114 (as in FIG. 10) or to keep the vehicle following the vibration generating structure 124 (as in FIG. 13).

Additionally, the angle θ may be used in the groove length determination by the vibration signal analyzer 802. When the vehicle 116 rides over the vibration generating structure 124 in an angle θ as shown in FIGS. 14A and 14B, then the vibration signal frequency F and the groove length L have the following relation:

$$F=(V*\cos\theta)/L \text{ (Hertz)}$$

$$L=(V*\cos\theta)/F$$

Thus, the angle θ is useful for accurate groove length determination.

In this manner, the vehicle assistance system of the present invention uses vibration signals generated by at least one vibration sensor disposed on the vehicle to determine a driving situation and to provide proper assistance for that driving situation. The vibration generating structures may already exist on the road as is presently common near toll booths or curves on highways, or such vibration generating structures may be more commonly disposed on the road in the future.

Such a vehicle assistance system is advantageous because typical vibration sensors are relatively low-cost sensors. Moreover, such a vehicle assistance system which detects for direct contact of the vehicle to the vibration generating structure on the road may properly operate through adverse weather conditions of fog, rain, or snow whereas the prior art vehicle assistance systems that detect electromagnetic waves from the road may fail.

Additionally, installing vibration generating structures on the road provides benefit to vehicles that both do or do not have the vehicle assistance system 800 of the present invention installed thereon. Even if a vehicle does not have the vehicle assistance system 800 of the present invention installed thereon, the vehicle still vibrates and thereby warns the driver to be extra alert for dangerous driving conditions. Thus, installing such vibration generating structures on the road is not a waste even for vehicles that do not have the vehicle assistance system 800 of the present invention installed thereon. In contrast, installing magnetic keys or the frequency selective strips of Young et al. with the prior art vehicle assistance systems may be useless for vehicles that do not carry the corresponding prior art vehicle assistance system thereon.

Figure 15A:
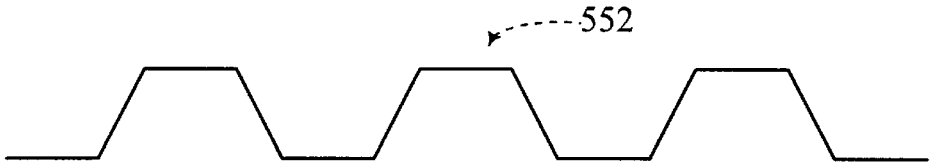
FIG. 15A shows an alternative shape for a vibration generating structure.

The foregoing is by way of example only and is not intended to be limiting. For example, the advantageous features of the present invention may be used in conjunction with any other type of vehicle assistance system. In addition, shapes of the vehicle vibration generating structures as shown in FIGS. 2A, 3A, 3B, and 3C are by way of example only, and the present invention may be used with any shape for the vibration generating structure such as an example alternative shape 552 shown in FIG. 15A.

Figure 15B:
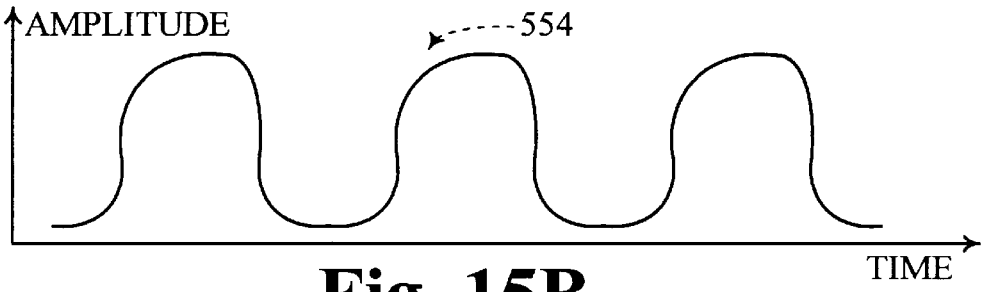
FIG. 15B shows a vibration signal resulting from vehicle contact with the vibration generating structure of FIG. 15A.
Figure 15C:
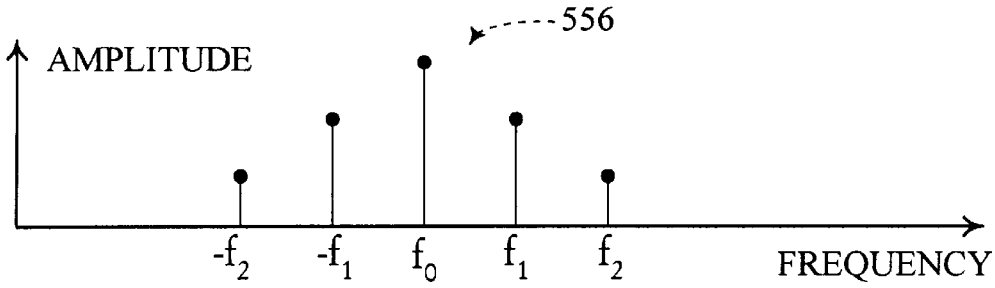
FIG. 15C shows Fourier-transformed frequency components of the vibration signal of FIG. 15B.

Furthermore, the driving situation may be determined from other analysis of vibration signals aside from just the example of determining the groove length of the vibration generating structure. Broadly, a vibration generating structure on the road has a predetermined shape for causing a predetermined effect on the respective vibration signal detected by the at least one sensor disposed on the vehicle to indicate a corresponding driving situation. For example, the vibration generating structure 552 of FIG. 15A may generate a vibration signal 554 of FIG. 15B. The vibration signal 554 may be Fourier-transformed to a frequency domain signal 556 of FIG. 15C. This frequency domain signal 556 includes information for determining the vibration generating structure that has been contacted by the vehicle and in turn for determining the corresponding driving situation of the vehicle. In this example, the respective frequency domain signal for various vibration generating structures may be predetermined, and the look-up table within the data storage unit 806 may include a match of a respective frequency domain signal for each driving situation.

Figure 16:
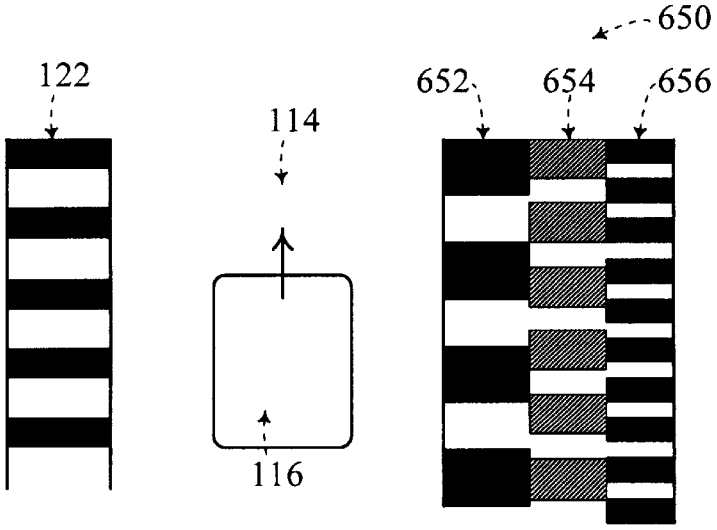
FIG. 16 shows a vibration generating structure on a side of a lane including a plurality of portions having different vibration generating structure shapes.

Furthermore, more intelligent and sophisticated vibration generating structures may be used in practice of the present invention. Referring to FIG. 16 for example, a sophisticated vibration generating structure 650 may be used on a side of the road lane 114 instead of the simpler vibration generating structure 124 of FIG. 1. The vibration generating structure 650 includes a plurality of portions with each portion having a respective groove length. Thus, a first portion 652 has the largest groove length, a second portion 654 has a medium groove length, and a third portion 656 has a smallest groove length.

The vibration generating structure 650 may indicate how far off the lane 114 the vehicle has traveled. If a vibration sensor on the vehicle 116 generates a vibration signal corresponding to the groove length of the third portion 656, then the driving situation is that the vehicle 116 has deviated far from the lane 114. In that case, the vehicle control unit 810 may provide an automatic vehicle assist action such as automatically steering the vehicle 116 back into lane 114. On the other hand, if the vibration signal corresponds to the groove length of the first portion 652, then the driving situation is that the vehicle 116 has not deviated too far from the lane 114. In that case, the vehicle warning unit 808 may simply provide a warning to the driver to stay within the lane 114.

Figure 17A:
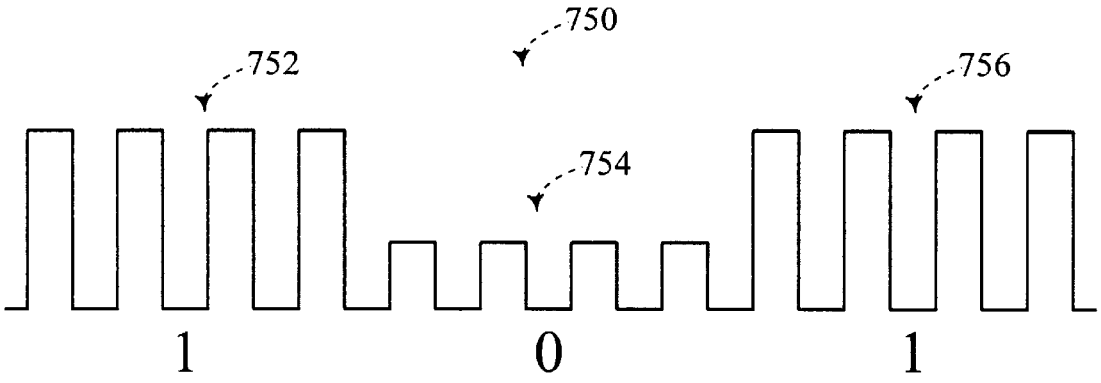
FIG. 17A shows a vibration generating structure including a plurality of portions for carrying binary data.

Additionally, a sophisticated vibration generating structure may encode digital information. Referring to FIG. 17A for example, a vibration generating structure 750 may include a series of portions with each portion having either a tall height or a short height. In FIG. 17A, a first portion 752 has grooves with a tall height, a second portion 754 has grooves with short height, and a third portion 756 has grooves with tall height. The vehicle travels from the first portion 752 toward the third portion 756, and a respective vibration signal is generated when the vehicle rides over each portion.

Figure 17B:
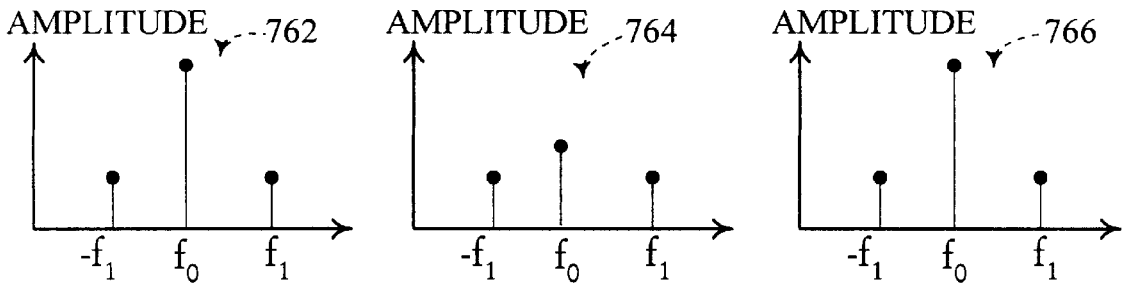
FIG. 17B shows a respective Fourier-transformed frequency component signal for each of the plurality of vibration generating structure portions of FIG. 17A.

The first and third portions 752 and 756 which have grooves with tall height may cause vibration signals with higher amplitude than the second portion 754 which has grooves with short height. Referring to FIG. 17B, a first frequency component signal 762 corresponds to a vibration signal that is generated when a vehicle rides over the first portion 752. A second frequency component signal 764 corresponds to a vibration signal that is generated when a vehicle rides over the second portion 754. A third frequency component signal 766 corresponds to a vibration signal that is generated when a vehicle rides over the third portion 756. Note that the main central frequency component $f_0$ for the first and third signals 762 and 766 respectively have greater amplitude than for the second signal 764.

Such information may be used to assign a binary bit to each portion of the vibration generating structure 750. Referring to FIGS. 17A and 17B, when a frequency component amplitude is greater than a threshold value, then a high bit of "1" may be assigned. When a frequency component amplitude is less than the threshold value, then a low bit of "0" may be assigned. In this manner, the sophisticated vibration generating structure 750 may carry a bit pattern which may be correlated to a specific driving situation.

Thus, the present invention may be used with vibration generating structures of any shape and pattern for carrying information relating to a driving situation of a vehicle. Generally, the vibration signal that is generated at a vibration sensor when the vehicle contacts such vibration generating structures on the road may be used in conjunction with any signal processing and analysis techniques as is known to one of ordinary skill in the art of signal processing.

Therefore, the invention is limited only as defined in the following claims and equivalents thereof.

I claim:

1. An apparatus for assisting a driver of a vehicle on a road having vibration generating structure, the apparatus comprising:

at least one vibration sensor, each vibration sensor disposed on a respective location on the vehicle and detecting vibration of the vehicle when the vehicle contacts the vibration generating structure on the road to generate a respective vibration signal; and a vibration signal analyzer, operatively coupled to the at least one vibration sensor, for analyzing the respective vibration signal from the at least one vibration sensor to determine a driving situation of the vehicle;

wherein the vibration generating structure has a predetermined shape for causing a predetermined effect on the respective vibration signal detected by the at least one vibration sensor to indicate a corresponding driving situation;

and wherein the vibration generating structure includes periodic grooves, each groove having a groove length that corresponds to a respective driving situation.

2. The apparatus of claim 1, further comprising:

a warning unit, operatively coupled to the vibration signal analyzer, for warning at least one of the driver of the vehicle and another person on the road of the driving situation of the vehicle.

3. The apparatus of claim 2, wherein the driving situation is one of the vehicle running off a lane, the vehicle approaching an intersection, and the vehicle approaching a curve, and wherein the warning unit provides a respective warning for each driving situation.

4. The apparatus of claim 1, further comprising:

a vehicle control unit, operatively coupled to the vibration signal analyzer, for automatically controlling the vehicle to compensate for the driving situation of the vehicle.

5. The apparatus of claim 4, wherein the driving situation is one of the vehicle running off a lane, the vehicle approaching an intersection, and the vehicle approaching a curve, and wherein the vehicle control unit controls the vehicle to provide a respective automatic vehicle assist action to compensate for each driving situation.

6. The apparatus of claim 5, wherein the vehicle control unit allows the driver of the vehicle to override the respective automatic vehicle assist action when the driver manually controls the vehicle.

7. The apparatus of claim 1, wherein the driving situation is determined at least in part by the respective location of the at least one vibration sensor.

8. The apparatus of claim 1, further comprising:

a navigation system input for accepting GPS (Global Positioning System) information for use in determining the driving situation.

9. The apparatus of claim 8, further comprising:

a roadmap database, operatively coupled to the vibration signal analyzer, which includes vibration generating structure information of the road.

10. An apparatus for assisting a driver of a vehicle on a road having vibration generating structure, the apparatus comprising:

at least one vibration sensor, each vibration sensor disposed on a respective location on the vehicle and detecting vibration of the vehicle when the vehicle contacts the vibration generating structure on the road to generate a respective vibration signal;

a vibration signal analyzer, operatively coupled to the at least one vibration sensor, for analyzing the respective vibration signal from the at least one vibration sensor to determine a driving situation of the vehicle; and a navigation system input for accepting GPS (Global Positioning System) information for use in determining the driving situation.

11. The apparatus of claim 10, further comprising:

a roadmap database, operatively coupled to the vibration signal analyzer, which includes vibration generating structure information of the road.

12. The apparatus of claim 10, further comprising:

a warning unit, operatively coupled to the vibration signal analyzer, for warning at least one of the driver of the vehicle and another person on the road of the driving situation of the vehicle.

13. The apparatus of claim 12, wherein the driving situation is one of the vehicle running off a lane, the vehicle approaching an intersection, and the vehicle approaching a curve, and wherein the warning unit provides a respective warning for each driving situation.

14. The apparatus of claim 10, further comprising:

a vehicle control unit, operatively coupled to the vibration signal analyzer, for automatically controlling the vehicle to compensate for the driving situation of the vehicle.

15. The apparatus of claim 14, wherein the driving situation is one of the vehicle running off a lane, the vehicle approaching an intersection, and the vehicle approaching a curve, and wherein the vehicle control unit controls the vehicle to provide a respective automatic vehicle assist action to compensate for each driving situation.

16. The apparatus of claim 15, wherein the vehicle control unit allows the driver of the vehicle to override the respective automatic vehicle assist action when the driver manually controls the vehicle.

17. The apparatus of claim 10, wherein the vibration generating structure has a predetermined shape for causing a predetermined effect on the respective vibration signal detected by the at least one vibration sensor to indicate a corresponding driving situation.

18. The apparatus of claim 10, wherein the driving situation is determined at least in part by the respective location of the at least one vibration sensor.

19. An apparatus for assisting a driver of a vehicle on a road having vibration generating structure, the apparatus comprising:

at least one vibration sensor, each vibration sensor disposed on a respective location on the vehicle and detecting vibration of the vehicle when the vehicle contacts the vibration generating structure on the road to generate a respective vibration signal;

a vibration signal analyzer, operatively coupled to the at least one vibration sensor, for analyzing the respective vibration signal from each of the at least one vibration sensor and the respective location of each of the at least one vibration sensor to determine a driving situation of the vehicle, wherein the vibration generating structure has a groove length for causing a predetermined effect on each of the respective vibration signal detected by the at least one vibration sensor to indicate a corresponding driving situation:

a navigation system input for accepting GPS (Global Positioning System) information for use in determining the driving situation;

a roadmap database, operatively coupled to the vibration signal analyzer, which includes vibration generating structure information of the road;

a warning unit, operatively coupled to the vibration signal analyzer, for warning at least one of the driver of the vehicle and another person on the road of the driving situation of the vehicle; and a vehicle control unit, operatively coupled to the vibration signal analyzer, for controlling the vehicle with an automatic vehicle assist action to compensate for the driving situation of the vehicle, wherein the vehicle control unit allows the driver of the vehicle to override the automatic vehicle assist action when the driver manually controls the vehicle.

20. An apparatus for assisting a driver of a vehicle on a road having vibration generating structure, the apparatus comprising:

means for detecting vibration on at least one location of the vehicle when the vehicle contacts the vibration generating structure on the road to generate a respective vibration signal for each of the at least one location of the vehicle;

wherein the vibration generating structure includes periodic grooves, each groove having a groove length that corresponds to a respective driving situation; and means for determining said groove length of said vibration generating structure from said respective vibration signal when said vehicle contacts the vibration generating structure to determine said respective driving situation.

21. The apparatus of claim 20, further comprising:

means for warning at least one of the driver of the vehicle and another person on the road of the driving situation of the vehicle.

22. The apparatus of claim 20, further comprising:

means for automatically controlling the vehicle to compensate for the driving situation of the vehicle.

23. A method for assisting a driver of a vehicle on a road having vibration generating structure, the method including the steps of:

detecting vibration of the vehicle on at least one location of the vehicle when the vehicle contacts the vibration generating structure on the road to generate a respective vibration signal for each of the at least location of the vehicle; and analyzing the respective vibration signal from the at least one location of the vehicle to determine a driving situation of the vehicle;

wherein the vibration generating structure has a predetermined shape for causing a predetermined effect on the respective vibration signal detected at the at least one location to indicate a corresponding driving situation;

and wherein the vibration generating structure includes periodic grooves, each groove having a groove length that corresponds to a respective driving situation.

24. The method of claim 23, further including the step of:

warning at least one of the driver of the vehicle and another person on the road of the driving situation of the vehicle.

25. The method of claim 24, wherein the driving situation is one of the vehicle running off a lane, the vehicle approaching an intersection, and the vehicle approaching a curve, and wherein the step of warning includes a step of providing a respective warning for each driving situation.

26. The method of claim 23, further including the step of:

controlling the vehicle to compensate for the driving situation of the vehicle.

27. The method of claim 26, wherein the driving situation is one of the vehicle running off a lane, the vehicle approaching an intersection, and the vehicle approaching a curve, and wherein the step of controlling includes a step of compensating for each driving situation with a respective automatic vehicle assist action.

28. The method of claim 27, wherein the step of controlling includes a step of allowing the driver of the vehicle to override the respective automatic vehicle assist action when the driver manually controls the vehicle.

29. The method of claim 23, wherein each of the at least one location corresponding to each of the respective vibration signal determines the driving situation.

30. The method of claim 23, further including the step of:

accepting GPS (Global Positioning System) information for use in determining the driving situation.

31. The method of claim 30, further including the step of:

accepting vibration generating structure information of the road from a roadmap database for use in determining the driving situation.

32. A method for assisting a driver of a vehicle on a road having vibration generating structure, the method including the steps of:

detecting vibration of the vehicle on at least one location of the vehicle when the vehicle contacts the vibration generating structure on the road to generate a respective vibration signal for each of the at least location of the vehicle;

analyzing the respective vibration signal from the at least one location of the vehicle to determine a driving situation of the vehicle; and accepting GPS (Global Positioning System) information for use in determining the driving situation.

33. The method of claim 32, further including the step of:

accepting vibration generating structure information of the road from a roadmap database for use in determining the driving situation.

34. The method of claim 32, further including the step of:

warning at least one of the driver of the vehicle and another person on the road of the driving situation of the vehicle.

35. The method of claim 34, wherein the driving situation is one of the vehicle running off a lane, the vehicle approaching an intersection, and the vehicle approaching a curve, and wherein the step of warning includes a step of providing a respective warning for each driving situation.

36. The method of claim 32, further including the step of:

controlling the vehicle to compensate for the driving situation of the vehicle.

37. The method of claim 36, wherein the driving situation is one of the vehicle running off a lane, the vehicle approaching an intersection, and the vehicle approaching a curve, and wherein the step of controlling includes a step of compensating for each driving situation with a respective automatic vehicle assist action.

38. The method of claim 37, wherein the step of controlling includes a step of allowing the driver of the vehicle to override the respective automatic vehicle assist action when the driver manually controls the vehicle.

39. The method of claim 32, wherein each of the at least one location corresponding to each of the respective vibration signal determines the driving situation.

40. A method for assisting a driver of a vehicle on a road having vibration generating structure, the method including the steps of:

detecting vibration of the vehicle on at least one location of the vehicle when the vehicle contacts the vibration generating structure on the road to generate a respective vibration signal for each of the at least one location of the vehicle;

analyzing the respective vibration signal from the at least one location of the vehicle to determine a driving situation of the vehicle, wherein the vibration generating structure has a predetermined shape for causing a predetermined effect on the respective vibration signal detected at the at least one location to indicate a corresponding driving situation, and wherein each of the at least one location corresponding to each of the respective vibration signal determines the driving situation;

warning at least one of the driver of the vehicle and another person on the road of the driving situation of the vehicle;

controlling the vehicle to compensate for the driving situation of the vehicle, wherein the step of controlling includes a step of:

allowing the driver of the vehicle to override the respective automatic vehicle assist action when the driver manually controls the vehicle; and accepting GPS (Global Positioning System) information and vibration generating structure information of the road from a roadmap database for use in determining the driving situation.

41. A road having a vehicle driven thereon, the vehicle including a vibration sensor for generating a vibration signal, the road comprising:

a plurality of vibration generating structures, each vibration generating structure having respective grooves with each groove having a respective groove length for causing a respective predetermined effect on the vibration signal generated by the vibration sensor when the vehicle contacts said vibration generating structure to indicate a corresponding driving situation of the vehicle.

* * * * *